US008839938B2

(12) United States Patent
Shimizu et al.

(10) Patent No.: US 8,839,938 B2
(45) Date of Patent: Sep. 23, 2014

(54) COIN RECEIVING AND DISPENSING MACHINE

(75) Inventors: Tokuharu Shimizu, Osaka (JP); Hirohumi Haruna, Kyoto (JP)

(73) Assignee: Laurel Machinery Co., Ltd., Osaka (JP)

( * ) Notice: Subject to any disclaimer, the term of this patent is extended or adjusted under 35 U.S.C. 154(b) by 675 days.

(21) Appl. No.: 12/186,835

(22) Filed: Aug. 6, 2008

(65) Prior Publication Data

US 2009/0042498 A1 Feb. 12, 2009

(30) Foreign Application Priority Data

Aug. 10, 2007 (JP) ..... P2007-210202

(51) Int. Cl.

| | |
|---|---|
| ***G07F 1/04*** | (2006.01) |
| ***G07D 3/16*** | (2006.01) |
| ***G07D 1/02*** | (2006.01) |

(52) U.S. Cl.

CPC ... *G07D 1/02* (2013.01); *G07D 3/16* (2013.01)
USPC ..... 194/346; 194/344; 453/7; 453/11; 453/15; 453/56

(58) Field of Classification Search

USPC ..... 453/6, 7, 56, 10–15, 21, 23, 33–35, 37, 453/38, 41, 43, 49, 57; 194/302, 344, 346
See application file for complete search history.

(56) References Cited

U.S. PATENT DOCUMENTS

| | | | |
|---|---|---|---|
| 5,059,153 | A | 10/1991 | Goi |
| 5,366,407 | A | 11/1994 | Sentoku |
| 2004/0238320 | A1 | 12/2004 | Hino et al. |
| 2006/0027437 | A1* | 2/2006 | Guindulain Vidondo .... 194/350 |

FOREIGN PATENT DOCUMENTS

| | | |
|---|---|---|
| DE | 39 24 247 A1 | 1/1990 |
| EP | 0 831 431 A2 | 3/1998 |
| EP | 1 367 544 A2 | 12/2003 |
| JP | 4-111090 | 4/1992 |

(Continued)

OTHER PUBLICATIONS

Office Action and English Translation for corresponding Korean Application No. 10-2008-0076597, Apr. 15, 2010, 6 pages.

(Continued)

*Primary Examiner* — Jeffrey Shapiro
(74) *Attorney, Agent, or Firm* — Nixon & Vanderhye P.C.

(57) ABSTRACT

The coin receiving and dispensing machine of the present invention includes a plurality of storing and feeding parts provided for each of denominations, which dispense coins to a coin outlet as required, and each of the plurality of storing and feeding parts includes: a first storing part which receives coins that are input and classified by one of the denominations; a second storing part which is provided parallel to the first storing part in a horizontal direction, and stores coins separately from the first storing part; a first conveying part which separates and conveys the coins stored in the first storing part one by one; a differentiating part which differentiates the denominations of the coins conveyed by the first conveying part, and counts quantity of the coins; a coin switching part which switches the coins differentiated and counted by the differentiating part to either one of the coin outlet and the second storing part selectively; and a second conveying part which conveys the coins stored in the second storing part to the first storing part.

9 Claims, 8 Drawing Sheets

(56) References Cited

FOREIGN PATENT DOCUMENTS

| | | |
|---|---|---|
| JP | H07-114662 | 5/1995 |
| JP | 2001-006015 | 1/2001 |
| JP | 2003-030713 | 1/2003 |
| JP | 2005-228084 | 8/2005 |
| JP | 2007-122134 | 5/2007 |

OTHER PUBLICATIONS

Notice of Allowance and English Translation for corresponding Japanese Application No. 2007-210202, mailed May 22, 2012, 6 pages.

* cited by examiner

COIN RECEIVING AND DISPENSING MACHINE

BACKGROUND OF THE INVENTION

1. Field of the Invention

The present invention relates to a coin receiving and dispensing machine that stores the coins input, and can also dispense the coins stored.

Priority is claimed on Japanese Patent Application No. 2007-210202, filed on Aug. 10, 2007, the content of which is incorporated herein by reference.

2. Description of Related Art

In general, a coin receiving and dispensing machine performs the following operations. When coins are inserted in a state of mixed denominations, the machine selects and counts them by denomination, and holds them temporarily in temporary holding parts by denomination. In the case where an approval operation is input to approve the selected and calculated results, the coins held temporarily by denomination are stored in storing and feeding parts by denomination. In the case where a cancel operation is directed, the coins held temporarily by denomination are returned. Furthermore, the coin receiving and dispensing machine can dispense coins stored in the storing and feeding parts by denomination as required. A circulating type coin receiving and dispensing machine disclosed in Japanese Unexamined Patent Application, First Publication No. 2001-6015, in which coins received are used for coin dispensing, can perform a checking process that confirms the quantities of the coins stored in storing and feeding parts. The coin receiving and dispensing machine has one more storing and feeding part than the number of denominations of coins to be handled. The coin receiving and dispensing machine performs operations sequentially, whereby it performs the checking process while conveying coins from the storing and feeding part for one denomination to an empty storing and feeding part, and performs the checking process while conveying coins from the next storing and feeding part for one denomination to the storing and feeding part that was emptied by the previous checking process.

In the coin receiving and dispensing machine disclosed in Japanese Unexamined Patent Application, First Publication No. 2001-6015 there is a problem in that the checking process requires a long time because the checking process is performed sequentially by denomination.

SUMMARY OF THE INVENTION

The present invention has an object of providing a coin receiving and dispensing machine that can perform a checking process in a short time.

In order to achieve the above object, the coin receiving and dispensing machine of the present invention includes a plurality of storing and feeding parts provided for each of denominations, which dispense coins to a coin outlet as required, and each of the plurality of storing and feeding parts includes: a first storing part which receives coins that are input and classified by one of the denominations; a second storing part which is provided parallel to the first storing part in a horizontal direction, and stores coins separately from the first storing part; a first conveying part which separates and conveys the coins stored in the first storing part one by one; a differentiating part which differentiates the denominations of the coins conveyed by the first conveying part, and counts quantity of the coins; a coin switching part which switches the coins differentiated and counted by the differentiating part to either one of the coin outlet and the second storing part selectively; and a second conveying part which conveys the coins stored in the second storing part to the first storing part.

According to this construction, in each of the plurality of storing and feeding parts provided by denomination, if the coins are separated one by one and conveyed by the first conveying part from the first storing part, which receives coins that is input and classified by being selected by denomination, while differentiating the denominations of the coins and counting the quantity of the coins by the differentiating part, and are switched to the coin outlet by the coin switching part, it is possible to dispense the coins. Furthermore, in each of the plurality of storing and feeding parts provided by denomination, if the coins are separated one by one and conveyed by the conveying part from the first storing part while differentiating the denominations of the coins and counting the coins by the differentiating part, and are switched toward the second storing part, which can store coins separately from the first storing part, by the coin switching part, it is possible to perform checking processing. Moreover, if, afterwards, the coins are returned from the second storing part to the first storing part by the second conveying part, the coins can be in the state of waiting for being dispensed to the coin outlet. In addition, since a first storing part, a second storing part, a first conveying part, a second conveying part, a differentiating part, and a coin dispensing part are provided in each of the storing and feeding parts by denomination, it is possible to perform a checking process in parallel.

As a result, it is possible to perform the checking process in a short time. Furthermore, since the second storing part is provided parallel to the first storing part in the horizontal direction, it is possible to avoid great size in the vertical direction. Moreover, by arranging such that the direction that the first storing part and the second storing part are provided parallel to is the direction perpendicular to the direction that the storing and feeding parts by denomination are provided parallel to, it is also possible to avoid great overall size in the horizontal direction.

In the coin receiving and dispensing machine of the present invention, the first conveying part may include a separating roller which separates coins one by one, and the separating roller and the differentiating part may be provided in an upper part of the second storing part.

According to this construction, in both of a dispensing process in which coins are conveyed from the first storing part to the coin outlet, and the checking process in which coins are conveyed from the first storing part to the second storing part, the first conveying part separates the coins one by one using the separating roller. Therefore, it is possible to perform differentiation by the differentiating part correctly using a simple construction. Furthermore, since the separating roller and the differentiating part are provided in the upper part of the second storing part, the separating roller and the differentiating part can be arranged compactly.

In the coin receiving and dispensing machine of the present invention, the first conveying part may include a rotating disc which applies centrifugal force to coins by rotating and moves the coins toward an outside, and a separating and feeding part which separates the coins moved toward the outside by the rotating disc and feeds the coins one by one, and the rotating disc, the separating and feeding part, and the differentiating part may be provided in an upper part of the second storing part.

According to this construction, in both of the dispensing process for conveying coins from the first storing part toward the coin outlet, and the checking process for conveying coins from the first storing part to the second storing part, the rotating disc of the first conveying part applies centrifugal force to the coins by rotating, and moves the coins toward the outside, and the separating and feeding part separates the coins and feeds them one by one. Therefore, it is difficult for coins to become jammed or the like. As a result, it is possible to separate the coins reliably for differentiation by the differentiating part. Furthermore, the rotating disc, the separating and feeding part, and the differentiating part are provided in the upper part of the second storing part. As a result, the rotating disc, the separating and feeding part, and the differentiating part, can be arranged compactly.

In the coin receiving and dispensing machine of the present invention, the coin switching part may include a gate that opens and closes, and the coin receiving and dispensing machine may further include a mode setting part which receives selection and setting of either one of a coin dispensing mode and a coin checking mode, and a gate control part which controls the opening and closing of the gate based on a mode set by using the mode setting part.

According to this construction, the coin switching part switches the coins differentiated and counted by the coin differentiating part to either one of the second storing part and the coin outlet, selectively. In this manner, the coins can be switched using a simple construction. Furthermore, since the gate control part controls the opening and closing of the gate based on the mode set by using the mode setting part, the gate can be opened and closed in accordance with the mode.

The coin receiving and dispensing machine of the present invention may further include an operation control part which performs a checking process in all of the plurality of storing and feeding parts in parallel in response to the coin checking mode set by the mode setting part, and the checking process may include the operations that all the coins stored in the first storing part are separated one by one and conveyed by the first conveying part, denominations of the coins are differentiated and quantity of the coins is counted by the differentiating part, and after the coins are stored in the second storing part by the coin switching part, the coins are returned to the first storing part by the second conveying part.

According to this construction, in the case where the coin checking mode is set by the mode setting part, the operation control part performs the checking process in all of the plurality of the storing and feeding parts in parallel. As a result, it is possible to perform the checking process in a short time.

In the coin receiving and dispensing machine of the present invention, the first storing part and the second storing part both may have approximately L-shaped plan views, and may be located such that orientations of the first storing part and the second storing part are 180 degrees opposite to each other, forming a square plan view overall.

According to this construction, the first storing part and the second storing part both have approximately L-shaped plan views, and are located such that their orientations are 180 degrees opposite to each other, forming a square plan view overall. Therefore, it is possible to arrange the two storing parts compactly.

In the coin receiving and dispensing machine of the present invention, the first conveying part may include a first belt conveyor, the first storing part may include a first conveyor location cavity forming part in which the first belt conveyor is installed, and a first storage cavity forming part in which coins are stored, and whose width is greater than a width of the first conveyor location cavity forming part, and may have an approximately L-shaped plan view, the second conveying part may include a second belt conveyor, the second storing part may include a second conveyor location cavity forming part in which the second belt conveyor is installed, and a second storage cavity forming part in which coins are stored, and whose width is greater than a width of the second conveyor location cavity forming part, and may have an approximately L-shaped plan view, and the first conveyor location cavity forming part of the first storing part and the second conveyor location cavity forming part of the second storing part may be arranged adjacent to each other.

According to this construction, the first storing part has a first conveyor location cavity forming part in which a first conveyor is installed, and a first storage cavity forming part whose width is greater than that of the first conveyor location cavity forming part, and has approximately L-shaped plan views. Moreover, the second storing part has a second conveyor location cavity forming part in which a second conveyor is installed, and a second storage cavity forming part whose width is greater than that of the first conveyor location cavity forming part, and has approximately L-shaped plan views. Furthermore, the first storing part and the second storing part are arranged such that their orientations are 180 degrees opposite to each other, and the first conveyor location cavity forming part and the second conveyor location cavity forming part are adjacent to each other. As a result, the first storing part and the second storing part are arranged to form a square shape overall. Therefore, it is possible to arrange the two storing parts compactly while ensuring that the quantity of coins that can be stored is maintained by making the size of the storage cavity forming parts large.

DETAILED DESCRIPTION OF THE INVENTION

Hereunder is a description of a coin receiving and dispensing machine according to a first embodiment of the present invention, with reference to FIG. 1 to FIG. 8.

Figure 1:
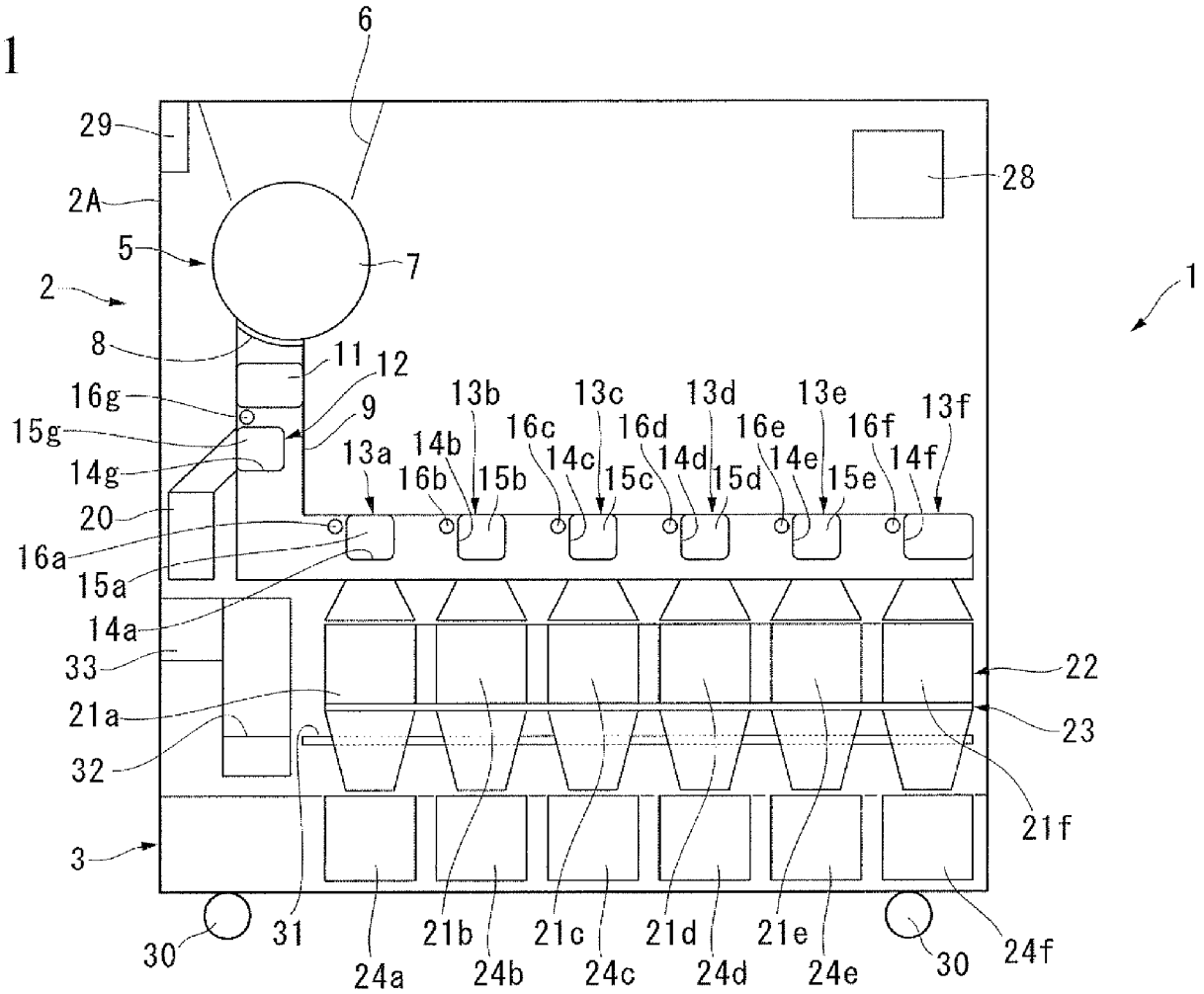
FIG. 1 is a side sectional view schematically showing the overall structure of a coin receiving and dispensing machine according to a first embodiment of the present invention.
Figure 2:
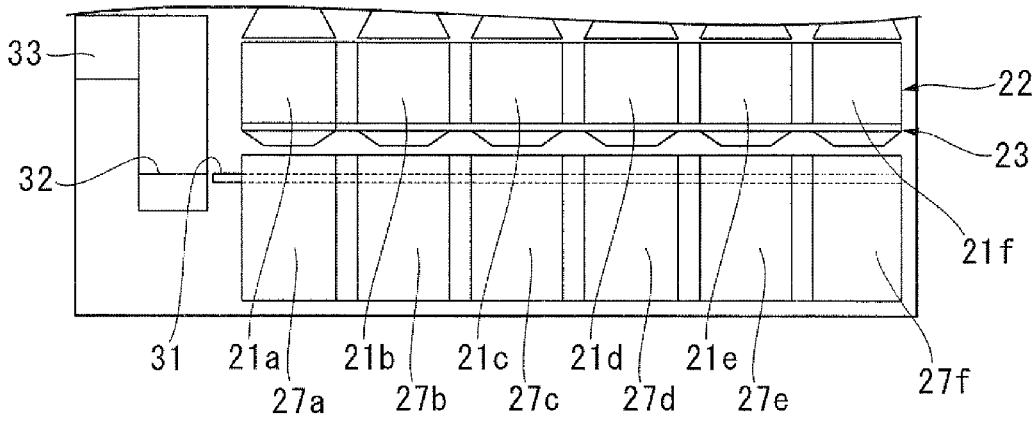
FIG. 2 is another side sectional view showing the structure of a lower part of the coin receiving and dispensing machine according to the first embodiment of the present invention.
Figure 3:
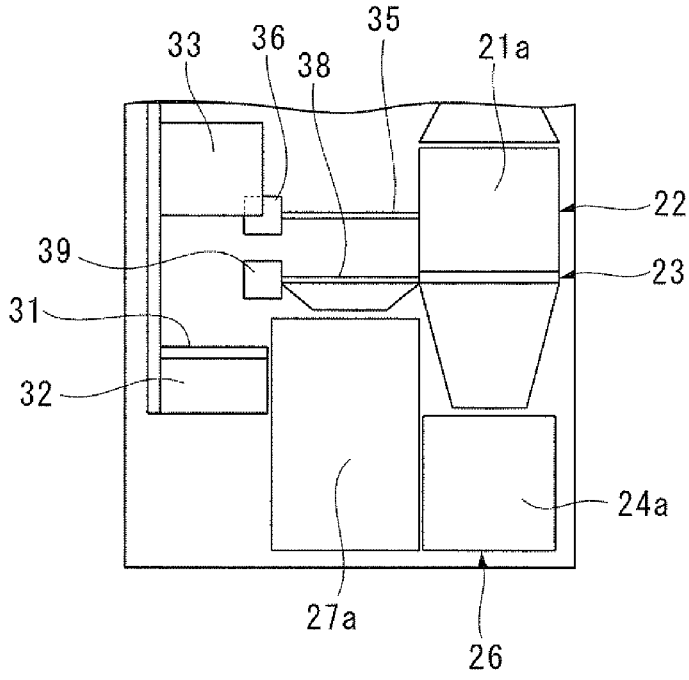
FIG. 3 is a front sectional view schematically showing the structure of the lower part of the coin receiving and dispensing machine according to the first embodiment of the present invention, and shows a state in which both a side partition part forming body and a base part forming body are located in a first position.

FIG. 1 to FIG. 3 schematically show a coin receiving and dispensing machine 1 according to the first embodiment. The coin receiving and dispensing machine 1 has an apparatus body 2 and a carriage section 3 that can be inserted in and removed from the apparatus body 2. The front and rear, right and left in the following description are defined as follows. The front designates the front side of the coin receiving and dispensing machine 1 as viewed by an operator. The rear designates the rear or furthermost side of the coin receiving and dispensing machine 1 as viewed by the operator. The right and left are the right and left of the coin receiving and dispensing machine 1 as viewed by the operator.

A separating and feeding section 5, which separates coins one by one which are dropped in so that they can be input, and conveys them, is provided in the upper part of the apparatus body 2. The coins are inserted together in a state of mixed denominations. The separating and feeding section 5 has a hopper 6, a rotating disc 7, a coin separating part 8, and a coin conveying part 9. Loose coins are inserted together into the hopper 6. The rotating disc 7 is installed on the lower side of the hopper 6 so as to form its base part. The coin separating part 8 has an aperture through which only one coin can pass, and it can feed coins one by one using centrifugal force when the rotating disc 7 rotates, and can also control the timing of feeding. The coin conveying part 9 conveys coins fed one by one by the coin separating part 8, horizontally.

An identifying part 11 is provided on the upstream side of the coin conveying part 9 in the apparatus body 2, and a reject part 12 is provided on the downstream side of the identifying part 11 in the coin conveying part 9. The identifying part 11 identifies whether the coins that are being conveyed by the coin conveying part 9 are genuine or counterfeit, and their denominations, and counts them. The reject part 12 rejects coins that have been identified as coins other than genuine ones based on the identification result by the identifying part 11. Switching parts 13*a*, 13*b*, 13*c*, 13*d*, 13*e*, and 13*f* are arranged in a plurality of positions, to be specific six positions, which is the same number as the number of denominations handled (six types of one yen coin, five yen coin, ten yen coin, fifty yen coin, one hundred yen coin, and five hundred yen coin in Japan) on the downstream side of the reject part 12 in the coin conveying part 9, in this order, in the conveying direction of the coin conveying part 9. The switching parts 13*a* to 13*f* switch the coins that are identified as being genuine coins and are acceptable based on the identification result by the identifying part 11 by denomination. The switching parts 13*a* to 13*f* are all positioned on one side in the left and right direction of the apparatus body 2. To be specific, they are arranged on the right side, and arranged from the front to back of the apparatus body 2.

The switching parts 13*a* to 13*f* all have selection holes 14*a*, 14*b*, 14*c*, 14*d*, 14*e*, and 14*f* into which coins with the maximum diameter handled (500 yen coin in Japan) can be dropped. Shutters 15*a*, 15*b*, 15*c*, 15*d*, and 15*e*, which can open and close the selection holes 14*a* to 14*e* individually, are provided in the five switching parts 13*a* to 13*e* on the upstream side.

Coin sensors 16*a*, 16*b*, 16*c*, 16*d*, 16*e*, and 16*f* are provided on the upstream side of each of the switching parts 13*a* to 13*f* to detect the passage of coins. Similarly, the reject part 12 also has a reject hole 14*g*, a shutter 15*g* that can open and shut the reject hole 14*g*, and a coin sensor 16*a* on the upstream side. The coin sensors 16*a* to 16*g* are used to control the opening and closing timing of the corresponding shutters 15*a* to 15*e*, and 15*g*, respectively. Furthermore, the coin sensors 16*a* to 16*g* are used to detect whether there is a coins conveying jam or not.

The apparatus body 2 has a reject box 20, which can be attached and removed freely, and temporary holding parts 21*a*, 21*b*, 21*c*, 21*d*, 21*e*, and 21*f* in a plurality of positions, to be specific 6 positions, which is the same as the number of switching parts 13*a* to 13*f*. The reject box 20 receives coins rejected by the reject part 12 from the coin conveying part 6. The temporary holding parts 21*a* to 21*f* are provided corresponding one to one to each of the switching parts 13*a* to 13*f*, and hold the coins switched individually by each of the switching parts 13*a* to 13*f*, temporarily.

The farthest temporary holding part 21*a* on the upstream side, that is, the farthest forward, is provided below the farthest switching part 13*a* on the upstream side, that is, the farthest forward. The temporary holding part 21*a* receives coins dropped only from the selection hole 14*a* by the opening of the shutter 15*a* of the switching part 13*a*, and holds them temporarily. The temporary holding part 21*b* is provided below the switching part 13*b*. The temporary holding part 21*b* holds temporarily coins dropped only from the selection hole 14*b* by the opening of the shutter 15*b*. The temporary holding part 21*c* is provided below the switching part 13*c*. The temporary holding part 21*c* holds temporarily coins dropped only from the selection hole 14*c* by the opening of the shutter 15*c*. The temporary holding part 21*d* is provided below the switching part 13*d*. The temporary holding part 21*d* holds temporarily coins dropped only from the selection hole 14*d* by the opening of the shutter 15*d*. The temporary holding part 21*e* is provided below the switching part 13*e*. The temporary holding part 21*e* holds temporarily coins dropped only from the selection hole 14*e* by the opening of the shutter 15*e*. The farthest temporary holding part 21*f* on the downstream side, that is, the rearmost, is provided below the switching part 13*f*. The temporary holding part 21*f* holds temporarily coins dropped only from the selection hole 14*f*.

The side partition parts of each of the temporary holding parts 21*a* to 21*f* are formed individually in a common side partition part forming body 22, which can move horizontally in the left and right direction. Each of the apertures of the bottom parts can be closed by a common base part forming body 23 provided on the underside of the side partition part forming body 22 such that it can move horizontally in the left and right direction. That is, the side partition part forming body 22 has a pair of left and right side partition parts. Furthermore, the side partition part forming body 22 is provided with a plurality of dividing side partition parts, to be specific seven, between the side partition parts in the front to back direction, to partition each of the temporary holding parts 21*a* to 21*f*. One long base part forming body 23 is provided in the front to back direction such that it closes all of the bottom part apertures of the temporary holding parts 21*a* to 21 fat the same time, and opens them at the same time.

The side partition part forming body 22 is supported by a guide rail 35 disposed in the left and right direction, such that it can travel in a straight line. The side partition part forming body 22 is driven by a drive mechanism part 36, and travels back and forth along the guide rail 35. The side partition part forming body 22 can travel back and forth between a first position and a second position. The first position is a position below the switching parts 13*a* to 13*f* located on the right side of the apparatus body 2. The second position is a position shifted from the first position in the horizontal direction by the width of the side partition part forming body 22. In order to stop the side partition part forming body 22 at each of the positions, corresponding sensors, which are omitted in the figures, are provided at each of the positions.

The base part forming body 23 is supported by a guide rail 38 disposed in the left and right direction such that it can travel in a straight line. The base part forming body 23 is driven by a drive mechanism 39, and travels back and forth along the guide rail 38. The base part forming body 23 can travel back and forth between a first position and a second position. The first position is a position that closes all the bottom apertures of the temporary holding parts 21*a* to 21*f* in the side partition part forming body 22, which is in the first position, at the same time. The second position is a position shifted from the first position in the horizontal direction by the width of the side partition part forming body 22, and that opens all the bottom apertures of the temporary holding parts 21*a* to 21*f* in the side partition part forming body 22, which is in the first position, at the same time. In order to stop the base part forming body 23 at each of the positions, corresponding sensors, which are omitted in the figures, are provided at each of the positions.

The carriage section 3 is moved out toward the front face 2A side with respect to the apparatus body 2 by rotating casters 30 provided underneath it, and then removed and carried away from the apparatus body 2. Moreover, the carriage section 3 is installed in the apparatus body 2 by being inserted from the front face 2A side.

A return box 26 is installed in the carriage section 3, vertically below the side partition part forming body 22 and the base part forming body 23, which are in the first position, such that it can be attached and removed freely. The return box 26 has return holding parts 24*a*, 24*b*, 24*c*, 24*d*, 24*e*, and 24*f*, which are provided in line in the front to back direction, and are formed by partitioning the box 26 into a plurality of individual compartments, to be specific six, which is the same as the number of switching parts 13*a* to 13*f*. The return holding parts 24*a* to 24*f* of the return box 26 are the receiving destinations for coins when returning the coins held temporarily in the temporary holding parts 21*a* to 21*f*, to an operator.

Figure 4:
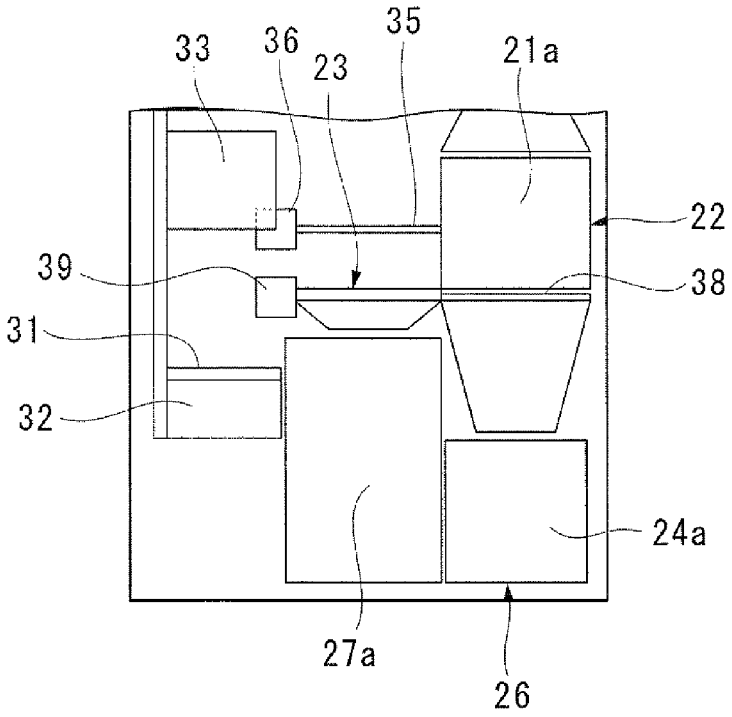
FIG. 4 is a front sectional view schematically showing the structure of the lower part of the coin receiving and dispensing machine according to the first embodiment of the present invention, and shows a state in which the side partition part forming body is located in the first position, and the base part forming body is located in a second position.

A control unit (gate control part, operation control part) 28 as show in FIG. 1, which controls each part, allows coins to be received from the plurality of switching parts 13*a* to 13*f* in a state in which the side partition part forming body 22 and the base part forming body 23, which form the temporary holding parts 21*a* to 21*f* are located in the first position, and the bottom part aperture of the side partition part forming body 22 is closed by the base part forming body 23 as shown in FIG. 3. Afterwards, the control unit 28 moves the base part forming body 23 horizontally to the second position using the drive mechanism 39 while leaving the side partition part forming body 22 in the first position as shown in FIG. 4. As a result, the coins held temporarily in the temporary holding parts 21*a* to 21*f* are dropped into the respective return holding parts 24*a* to 24*f* positioned below them. To be specific, only coins held temporarily in the temporary holding part 21*a* are dropped into the return holding part 24*a* positioned below it. Only coins held temporarily in the temporary holding part 21*b* are dropped into the return holding part 24*b* positioned below it. Only coins held temporarily in the temporary holding part 21*c* are dropped into the return holding part 24*c* positioned below it. Only coins held temporarily in the temporary holding part 21*d* are dropped into the return holding part 24*d* positioned below it. Only coins held temporarily in the temporary holding part 21*e* are dropped into the return holding part 24*e* positioned below it. Only coins held temporarily in the temporary holding part 21*f* are dropped into the return holding part 24*f* positioned below it. It is not necessary for the return box 26 to include individual return holding parts 24*a* to 24*f* which are formed by partitioning the box 26 into six. The return box 26 may include only one return holding part, having no partition, which can receive coins from the temporary holding parts 21*a* to 21*f*.

Storing and feeding parts 27*a*, 27*b*, 27*c*, 27*d*, 27*e*, and 27*f* which are arranged in line in the front to back direction, and partitioned into a plurality of individual compartments, to be specific six, which is the same as the number of switching parts 13*a* to 13*f*, and from which coins can be dispensed, are provided vertically below the side partition part forming body 22, which is on the side of the return box 26, and is in the second position. The storing and feeding parts 27*a* to 27*f* receive coins held temporarily in the temporary holding parts 21*a* to 21*f* individually, and store them by denomination. That is, the storing and feeding parts 27*a* to 27*f* are arranged by denomination such that they store coins by denomination that are input and classified by being selected by denomination.

Figure 5:
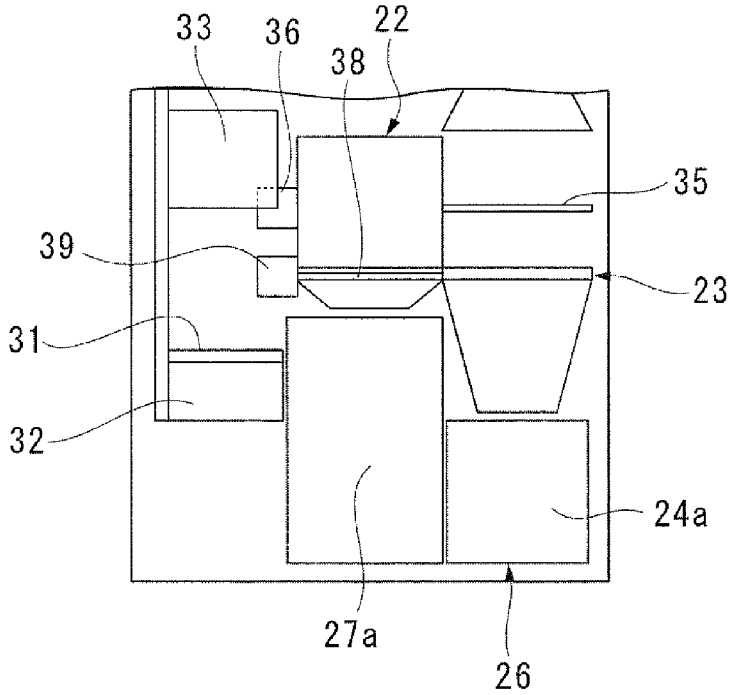
FIG. 5 is a front sectional view schematically showing the structure of the lower part of the coin receiving and dispensing machine according to the first embodiment of the present invention, and shows a state in which the side partition part forming body is located in the second position, and the base part forming body is located in the first position.

Similarly to the above, the control device 28 allows coins to be received from the plurality of switching parts 13*a* to 13*f* in a state in which the side partition part forming body 22 and the base part forming body 23 are located in the first position, and the aperture underneath the side partition part forming body 22 is closed by the base part forming body 23 as shown in FIG. 3. Afterwards, the control device 28 moves only the side partition part forming body 22 horizontally to the second position by a drive mechanism 36 while leaving the base part forming body 23 as it is as shown in FIG. 5. As a result, the coins held temporarily in the temporary holding parts 21*a* to 21*f* are dropped into respective storing and feeding parts 27*a* to 27*f* positioned below them. To be specific, only coins held temporarily in the temporary holding part 21*a* are dropped into the storing and feeding part 27*a* positioned below it. Only coins held temporarily in the temporary holding part 21*b* are dropped into the storing and feeding part 27*b* positioned below it. Only coins held temporarily in the temporary holding part 21*c* are dropped into the storing and feeding part 27*c* positioned below it. Only coins held temporarily in the temporary holding part 21*d* are dropped into the storing and feeding part 27*d* positioned below it. Only coins held temporarily in the temporary holding part 21*e* are dropped into the storing and feeding part 27*e* positioned below it. Only coins held temporarily in the temporary holding part 21*f* are dropped into the storing and feeding part 27*f* positioned below it.

The storing and feeding parts 27*a* to 27*f* can count and feed coins individually in order to dispense them. The coins fed from the storing and feeding parts 27*a* to 27*f* are collected by an elevator 32 on one side by normal rotation of a belt conveyor 31, which is to the side of them and extends horizontally front to rear. The collected coins are conveyed by the elevator 32 to a coin outlet 33 at the top. A coin recovery part (omitted in the drawings) is provided at the reverse side of the belt conveyor 31, which recovers coins by reverse rotation of the belt conveyor 31 in the case where there is a failure in feeding.

The abovementioned control device 28 is provided in the apparatus body 2. The control device 28 controls the whole coin receiving and dispensing machine 1. The control device 28 controls the separating and feeding section 5 for example, and also controls the switching parts 13*a* to 13*e*, and the shutters 15*a* to 15*e* and 15*g* of the reject part 12, individually, based on the identification result of the identifying part 11 and the detection results of the coin sensors 16*a* to 16*g*.

Furthermore, the control device 28 controls the drive mechanisms 36 and 39 of the side partition part forming body 22 and the base part forming body 23 individually based on detection by sensors, which are omitted in the drawings, and also controls the storing and feeding parts 27*a* to 27*f*, the belt conveyor 31, the elevator 32, and the like.

A display operation part (mode setting part) 29, which performs display to an operator, and takes inputs from the operator, is provided in the apparatus body 2. In the display operation part 29, a selecting and calculating mode, a coin dispensing mode, a coin checking mode, and the like can be selected and set. If the selecting and calculating mode is set, received coins are stored in the storing and feeding parts 27*a* to 27*f* by denomination as coins to be dispensed. If the coin dispensing mode is set, coins are dispensed to the coin outlet 33 from appropriate ones among the storing and feeding parts 27*a* to 27*f*. If the coin checking mode is set, the quantity of coins stored in the storing and feeding parts 27*a* to 27*f* is checked.

Next is a description of the storing and feeding parts 27*a* to 27*f* with reference mainly to FIG. 6 to FIG. 8. Since the storing and feeding parts 27*a* to 27*f* all have the same structure, the storing and feeding part 27*a* is described as an example in the following.

The storing and feeding part 27*a* has a first storing part 51 and a second storing part 52. The first storing part 51 receives coins only from the temporary holding part 21*a* (that is, one type of coin received and classified by selecting by denomination) when the abovementioned base part forming body 23 is in the first position, and the side partition part forming body 22 moves to the second position. The second storing part 52 is provided parallel to the first storing part 51 in the horizontal direction, and can store coins separately from the first storing part 51.

Figure 7A:
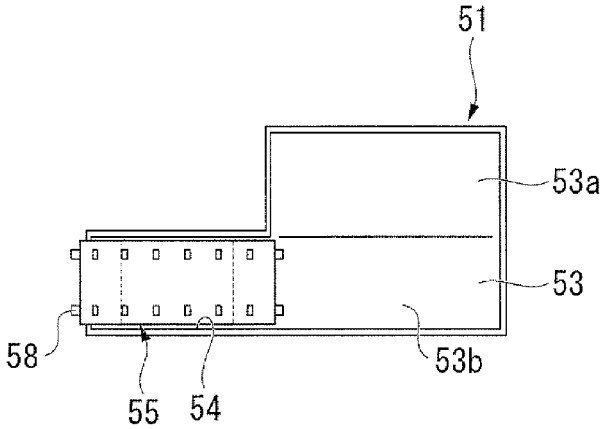
FIG. 7A is a plan view showing a first storing part of the coin receiving and dispensing machine according to the first embodiment of the present invention.
Figure 7B:
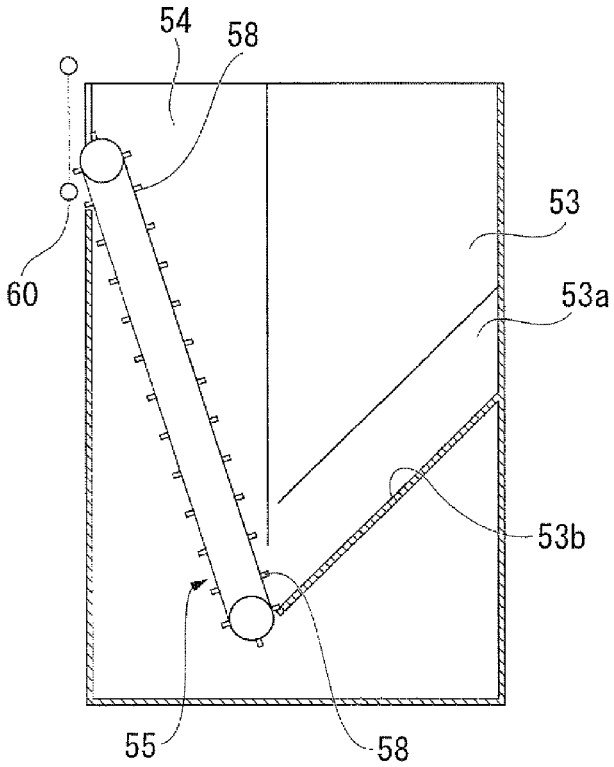
FIG. 7B is a front sectional view showing the first storing part of the coin receiving and dispensing machine according to the first embodiment of the present invention.
Figure 7C:
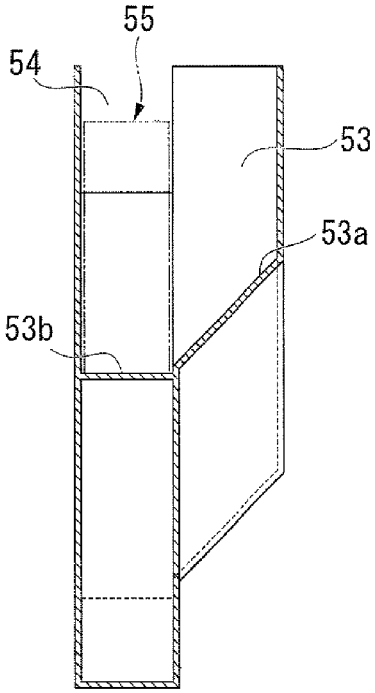
FIG. 7C is a side sectional view showing the first storing part of the coin receiving and dispensing machine according to the first embodiment of the present invention.

The first storing part 51, as shown in FIGS. 7A to 7C, includes a storage cavity forming part 53, which is wide in the front to back direction, and a conveyor location cavity forming part 54, which is half the width of the storage cavity forming part 53, and placed on only one side in the front to back direction of the storage cavity forming part 53. The first storing part 51 has an approximately L-shaped plan view. A base part 53*a* of the storage cavity forming part 53 is on the opposite side to the conveyor location cavity forming part 54 in the front to back direction. The base part 53*a* is an inclined plane that is inclined in both the front to back direction and the left and right direction such that its lower side is toward the conveyor location cavity forming part 54. A base part 53*b* of the storage cavity forming part 53 is to the side of the conveyor location cavity forming part 54 in the front to back direction. The base part 53*b* is an inclined plane that is inclined in the front to back direction in a location lower than the base part 53*a*, and such that its lower side is toward the conveyor location cavity forming part 54.

In the conveyor location cavity forming part 54, a belt conveyor (first conveying part) 55 is provided, which is inclined such that its lower side is toward the storage cavity forming part 53, and its higher side is opposite the storage cavity forming part 53. The belt conveyor 55 is an endless belt, and has a plurality of cleats 58 formed at a predetermined interval. Coins inserted into the storage cavity forming part 53 of the first storing part 51, and guided toward the conveyor location cavity forming part 54 side by the two base parts 53*a* and 53*b*, are conveyed to the higher side by holding on the cleats 58 when the belt conveyor 55 revolves. The cleats 58 are set to a height whereby each can hold only one coin. A counting sensor 60 is provided at the top end of the belt conveyor 55, and counts coins discharged from the end of the belt conveyor 55.

Figure 6A:
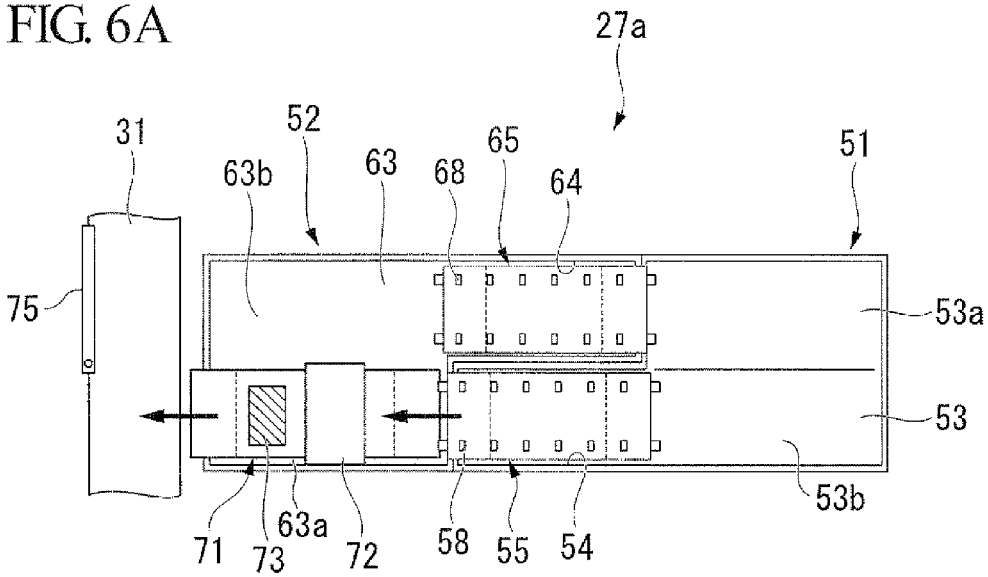
FIG. 6A is a plan view showing a storing and feeding part of the coin receiving and dispensing machine according to the first embodiment of the present invention.
Figure 6B:
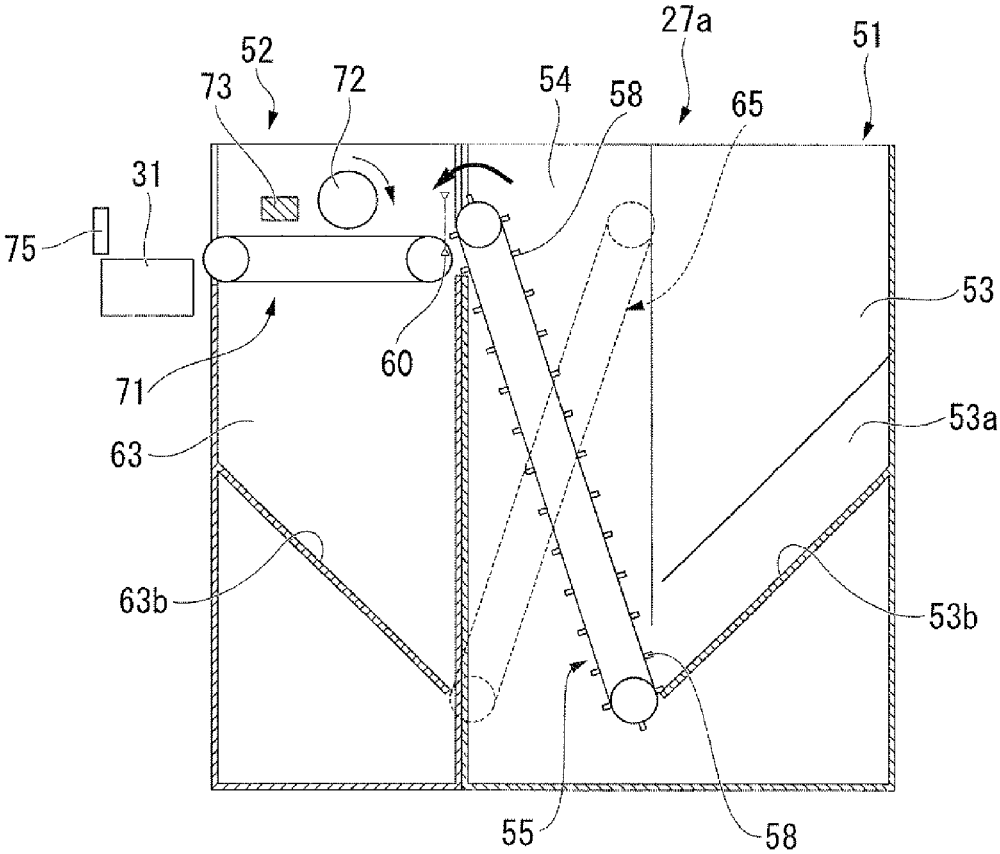
FIG. 6B is a front sectional view showing the storing and feeding part of the coin receiving and dispensing machine according to the first embodiment of the present invention.

The second storing part 52 has the same structure as the first storing part 51. The second storing part 52, as shown in FIG. 6A and FIG. 6B, includes a storage cavity forming part 63, which is wide in the front to hack direction, and a conveyor location cavity forming part 64, which is half the width of the storage cavity forming part 63, and placed on only one side in the front to back direction of the storage cavity forming part 63. The second storing part 52 has an approximately L-shaped plan view. A base part 63 a of the storage cavity forming part 63 is on the opposite side to the conveyor location cavity forming part 64 in the front to back direction. The base part 63*a* is an inclined plane that is inclined in both the front to back direction and the left and right direction such that its lower side is toward the conveyor location cavity forming part 64. The base part 63*b* of the storage cavity forming part 63 is to the side of the conveyor location cavity forming part 64 in the front to back direction. A base part 63*b* is an inclined plane that is inclined in the front to back direction in a location lower than the base part 63*a*, and such that its lower side is toward the conveyor location cavity forming part 64.

In the conveyor location cavity forming part 64, a belt conveyor (second conveying part) 65 is provided, which is inclined such that its lower side is toward the storage cavity forming part 63, and its higher side is opposite the storage cavity forming part 63. The belt conveyor 65 is an endless belt, and has a plurality of cleats 68 formed at a predetermined interval. Coins inserted into the storage cavity forming part 63 of the second storing part 52, and guided to the conveyor location cavity forming part 64 side by the two base parts 63*a* and 63*b*, are conveyed to the higher side by holding on the cleats 68 when the belt conveyor 65 revolves.

The first storing part 51 and the second storing part 52, which have approximately L-shaped plan views, are arranged such that orientations of the first storing part 51 and the second storing part 52 are 180 degrees opposite to each other. The conveyor location cavity forming parts 54 and 64 are positioned such that they make contact with each other in the front to back direction. The conveyor location cavity forming part 54 of the first storing part 51 and the storage cavity forming part 63 of the second storing part 52 are arranged such that they make contact in the left and right direction. The conveyor location cavity forming part 64 of the second storing part 52 and the storage cavity forming part 53 of the first storing part 51 are positioned such that they make contact in the left and right direction. Here, the width of the conveyor location cavity forming parts 54 and 64 is half the width of the storage cavity forming parts 53 and 63. Therefore, the first storing part 51 and the second storing part 52 are arranged such that they form a rectangular plan view as a whole, which is longer in the left and right direction. By arranging them in above-mentioned positions, if, in the second storing part 52, the belt conveyor 65 conveys coins, which are inserted into the storage cavity forming part 63, and guided to the conveyor location cavity forming part 64 side by the two base parts 63*a* and 63*b*, to the higher side by holding on the cleats 68, the coins are discharged into the storage cavity forming part 53 of the first storing part 51. That is, the belt conveyor 65 of the second storing part 52 conveys the coins stored in the second storing part 52 to the first storing part 51. The first storing part 51 and the second storing part 52 are arranged in parallel in the left and right direction. The storing and feeding parts 27*a* to 27*f*, which are provided for each denomination, are arranged in line in the front to back direction. Therefore, the direction in which the storing part 51 and the second storing part 52 are placed in parallel is perpendicular to the direction in which the storing and feeding parts 27*a* to 27*f* are placed in parallel.

A belt conveyor (first conveying part) 71 for conveying horizontally is provided in the upper part of the base part 63*a* of the storage cavity forming part 63 of the second storing part 52. The belt conveyor 71 receives coins conveyed upwards by the belt conveyor 55 of the first storing part 51 from the belt conveyor 55, and conveys and delivers them to the belt conveyor 31. A separating roller (first conveying part) 72 and a differentiating part 73 are provided above the belt conveyor 71. The separating roller 72 is located at one coin spacing from the belt conveyor 71 and thus separates the coins on the belt conveyor 71 one by one. The differentiating part 73 differentiates the denominations of the coins and counts the coins conveyed by the belt conveyor 71 and separated one by one by the separating roller 72 by detecting their magnetic properties. That is, the belt conveyor 71, the separating roller 72 which separates the coins on the belt conveyor 71 one by one, and the differentiating part 73, are provided in the upper part of the second storing part 52.

Figure 8A:
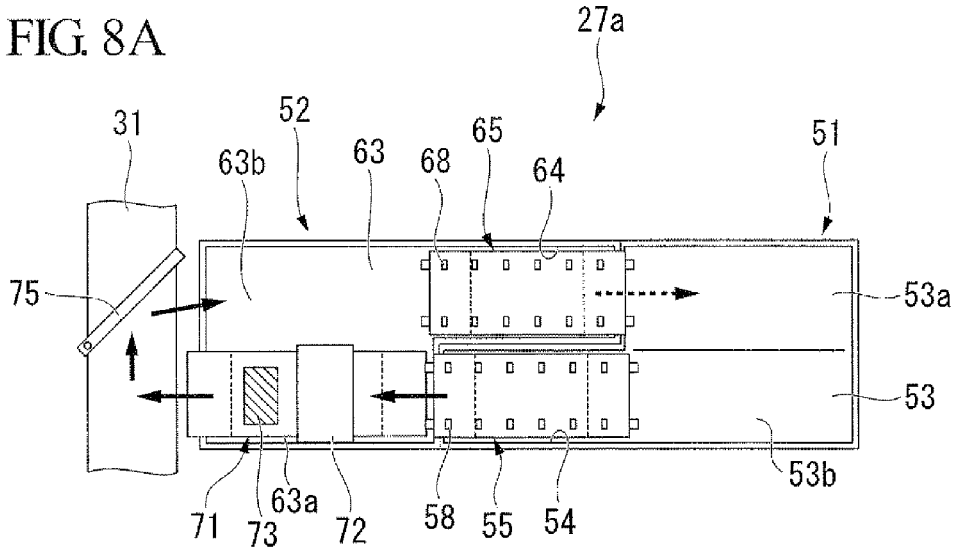
FIG. 8A is a plan view showing the storing and feeding part of the coin receiving and dispensing machine according to the first embodiment of the present invention.
Figure 8B:
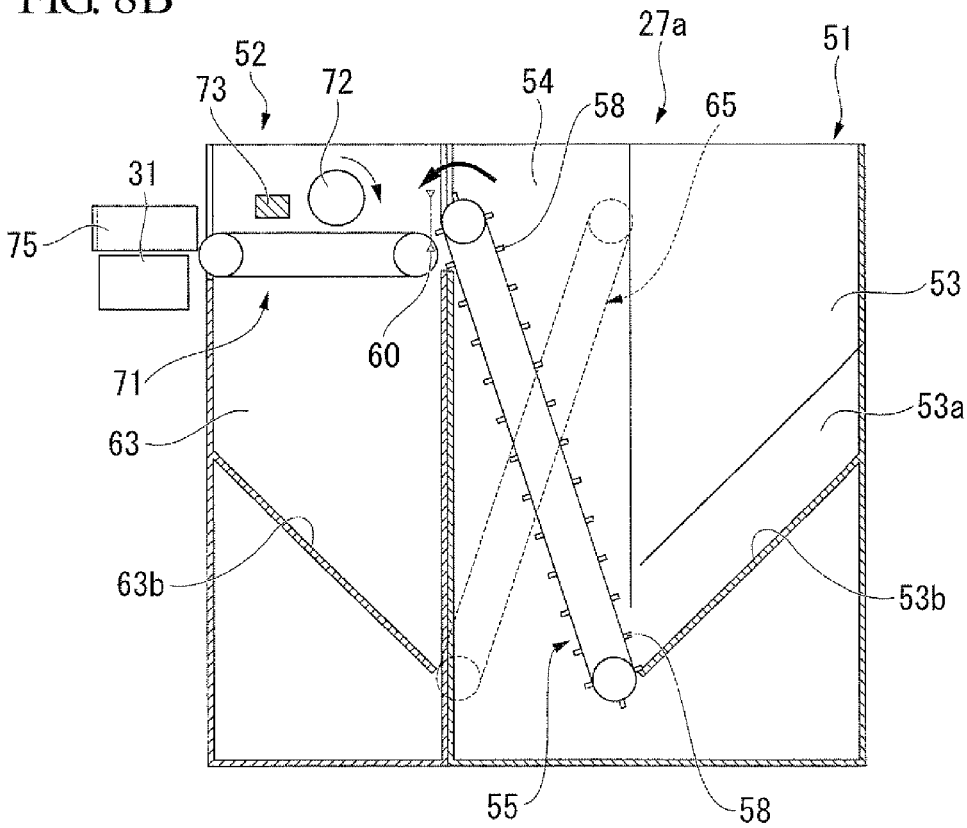
FIG. 8B is a front sectional view showing the storing and feeding part of the coin receiving and dispensing machine according to the first embodiment of the present invention.
Figure 9A:
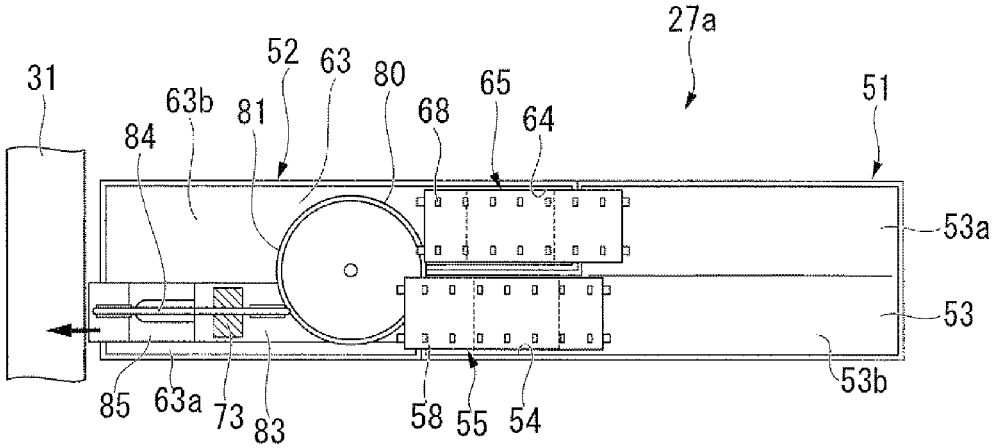
FIG. 9A is a plan view showing a storing and feeding part of a coin receiving and dispensing machine according to a second embodiment of the present invention.
Figure 9B:
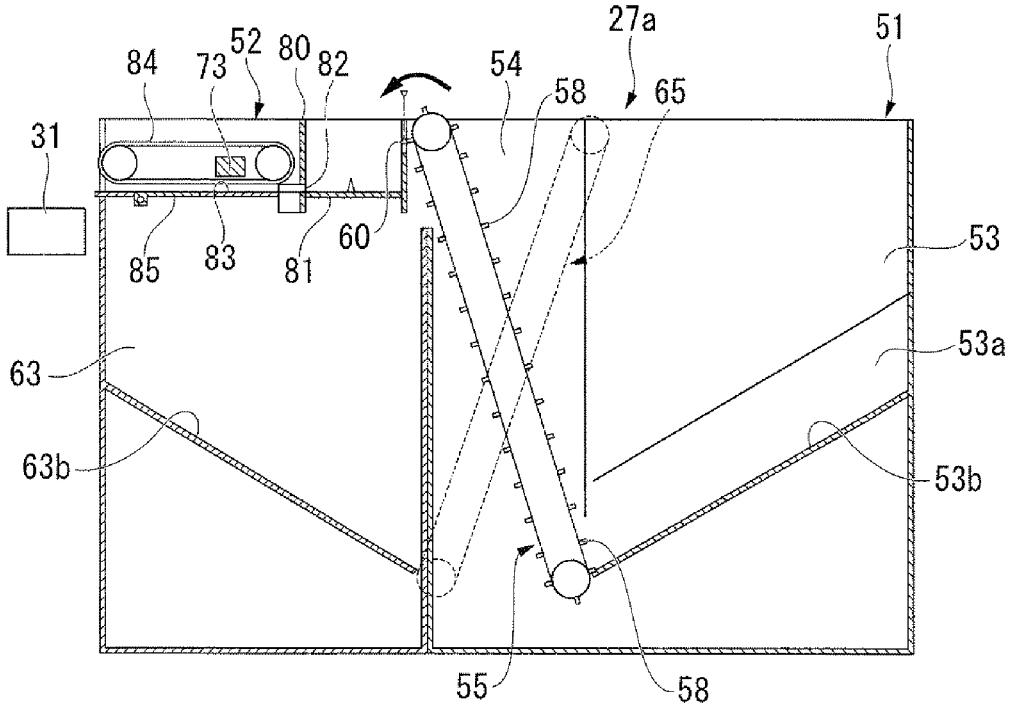
FIG. 9B is a front sectional view showing the storing and feeding part of the coin receiving and dispensing machine according to the second embodiment of the present invention.

The storing and feeding part 27*a* has an opening and closing gate (coin switching part) 75, which can be switched between an open state and a closed state. The open state is a state in which the coins delivered to the belt conveyor 31 from the belt conveyor 71 are kept conveyed by the belt conveyor 31 to deliver them to the elevator 32, and the elevator 32 conveys the coins to the coin outlet 33 at the top. The closed state is a state in which the coins delivered to the belt conveyor 31 are dropped into the storage cavity forming part 63 of the second storing part 52 by using the conveying power of the belt conveyor 31. That is, the gate 75 switches the conveyor destinations of the coins delivered to the belt conveyor 31 between the coin outlet 33 and the second storing part 52 selectively. To be specific, the gate 75 rotates about a vertical axis located on the opposite side of the belt conveyor 31 from the belt conveyor 71. In this manner, the gate 75 can switch between a closed state in which it swings over the belt conveyor 31 to guide the coins to the second storing part 52 as shown in FIG. 8A and FIG. 8B, and an open state in which it withdraws from the belt conveyer 31 as shown in FIG. 6A and FIG. 6B.

The storing and feeding parts 27*a* to 27*f* by denomination have the same structure. Therefore, each of the storing and feeding parts 27*a* to 27*f* has a first storing part 51, a belt conveyor 55, a second storing part 52, a belt conveyor 65, a belt conveyor 71, a separating roller 72, a differentiating part 73, and a gate 75.

Next is a description of the control performed by the control device 28 according to the first embodiment.

Regarding the side partition part forming body 22 and the base part forming body 23 constituting the temporary holding parts 21*a* to 21, their base positions are the first positions, which are below the switching parts 13*a* to 13*f*. After the side partition part forming body 22 and the base part forming body 23 are moved, they are always returned to their base positions to finish the movement (position as shown in FIG. 3).

[Selecting and Calculating Mode]

A case is described in which the selecting and calculating mode is selected and set by appropriate input to the display operation part 29.

When a start operation is input to the display operation part 29 in a state established by the selecting and calculating mode being set, the control device 28 allows coins inserted into the hopper 6 of the separating and feeding section 5 in a state of mixed denominations to pass through the coin separating part 8 one by one by centrifugal force due to the rotation of the rotating disc 7. Afterwards, the control device 28 commands the identifying part 11 to identify the coins. The control device 28 performs control such that all of the rejected coins identified as not acceptable based on the identification result in the identifying part 11 are returned to the reject box 20 by the reject part 12. Otherwise, the control device 28 controls the switching parts 13*a* to 13*f* such that genuine coins identified as acceptable are selected and switched by denomination.

To be specific, the control device 28 performs the following control. It opens the shutter 15*a* of the switching part 13*a* to allow coins identified as one yen coins by the identifying part 11 through the selection hole 14*a* to be held temporarily in the temporary holding part 21*a*. It allows coins identified as five yen coins by the identifying part 11 to pass through the switching part 13*a* with the shutter 15*a* being in a closed state, and opens the shutter 15*b* to allow them through the selection hole 14*b* to be held temporarily in the temporary holding part 21*b*. It allows coins identified as ten yen coins by the identifying part 11 to pass through the switching parts 13*a* and 13*b* with the shutters 15*a* and 15*b* being in a closed state, and opens the shutter 15*c* of the switching part 13*c* to allow them through the selection hole 14*c* to be held temporarily in the temporary holding part 21*c*. It allows coins identified as fifty yen coins by the identifying part 11 to pass through the switching parts 13*a* to 13*c* with the shutters 15*a* to 15*c* being in a closed state, and opens the shutter 15*d* of the switching part 13*d* to allow them through the selection hole 14*d* to be held temporarily in the temporary holding part 21*d*. It allows coins identified as one hundred yen coins by the identifying part 11 to pass through the switching parts 13*a* to 13*d* with the shutters 15*a* to 15*d* being in a closed state, and opens the shutter 15*e* of the switching part 13*e* to allow them through the selection hole 14*e* to be held temporarily in the temporary holding part 21*e*. It allows coins identified as five hundred yen coins by the identifying part 11 to pass through the switching parts 13*a* to 13*e* with the shutters 15*a* to 15*e* being in a closed state, and allows them through the selection hole 14*f* to be held temporarily in the temporary holding part 21*f*. Provided the pattern of switching each of the denominations to the temporary holding parts 21*a* to 21*f* is consistent, the setting is not limited to the above, and other settings may be used.

Genuine coins among the coins inserted into the hopper 6 in the above-described coin receiving process, identified as being acceptable based on the identification result by the identifying part 11, are all held temporarily in the temporary holding parts 21*a* to 21*f* by denomination. Next, the control device 28 displays the count result by denomination, and the total amount of money, in the display operation part 29. When an operator enters a cancel operation in the display operation part 29, the control device 28 moves the base part forming body 23 to the second position using the drive mechanism 39 while keeping the side partition part forming body 22 stopped in the first position, as shown in FIG. 4. In this manner, the coins held temporarily in the temporary holding parts 21*a* to 21*f* by denomination are delivered to corresponding return holding parts 24*a* to 24*f* in the return box 26, still by denomination. Then, the operator withdraws the return box 26 to retrieve the returned coins. After delivering the coins from the temporary holding parts 21*a* to 21*f* to the return box 26, the control device 28 returns the base part forming body 23 to the first position, being its base position, using the drive mechanism 39.

Alternatively, when the operator enters an approval operation in the display operation part 29, the control device 28 delivers the coins temporarily held in the temporary holding parts 21*a* to 21*f* by denomination to the storing and feeding parts 27*a* to 27*f*. That is, the control device 28 does not move the base part forming body 23, which is in the first position, but moves the side partition part forming body 22 horizontally to the second position using the drive mechanism 36 as shown in FIG. 5. In this manner, the coins temporarily held in the temporary holding parts 21*a* to 21*f* by domination are delivered to the corresponding storing and feeding parts 27*a* to 27*f*, still by denomination. That is, the coins input are selected and classified by denomination, and stored in the storing and feeding parts 27*a* to 27*f* by denomination. At this time, in all of the storing and feeding parts 27*a* to 27*f*, the coins are inserted in the first storing part 51, and are not inserted in the second storing part 52. After delivering the coins from the temporary holding parts 21*a* to 21*f* to the storing and feeding parts 27*a* to 27*f*, the control device 28 returns the side partition part forming body 22 to the first position, being its base position, using the drive mechanism 36.

[Coin Dispensing Mode]

A case is described in which the coin dispensing mode is selected and set by an appropriate input to the display operation part 29 being performed.

When a start operation is input to the display operation part 29 in a state in which the coin dispensing mode is selected and the quantity of coins to be dispensed is set by denomination, the control device 28 performs control corresponding to the coin dispensing mode set by the display operation part 29. To be specific, the control device 28 controls the belt conveyor 55 provided in the first storing part 51 of the storing and feeding parts from which coins are to be dispensed, among the storing and feeding parts 27*a* to 27*f*, and the belt conveyor 71, so that the belt conveyor 55 and the belt conveyor 71 are driven in the direction in which the coins are conveyed toward the belt conveyor 31, and controls the belt conveyor 31 so that the belt conveyor 31 is driven in the direction in which the coins are conveyed toward the elevator 32 waiting at the lower limit position, while keeping the gate 75 in an open state as show in FIG. 6A and FIG. 6B.

Then, the coins stored in the first storing part 51 in the storing and feeding parts from which coins are to be dispensed, among the storing and feeding parts 27*a* to 27*f*, are conveyed one by one by holding on the cleats 58 of the belt conveyor 55, and furthermore are separated one by one and conveyed by the belt conveyor 71 and the separating roller 72. The control device 28 stops the belt conveyor 55 when the quantity of coins required to be dispensed has been counted by the counting sensor 60. Moreover, the control device 28 differentiates the denominations of the coins which have been separated by the belt conveyor 71 and the separating roller 72 one by one and counts the quantity of the coins using the differentiating part 73 while delivering them to the belt conveyor 31, and afterwards stops the belt conveyor 71. The control device 28 commands all the storing and feeding parts of the storing and feeding parts 27*a* to 27*f* which store the coins to be dispensed, among the storing and feeding parts 27*a* to 27*f*, to feed all of the quantities of coins, being the objects of the dispensing, to the belt conveyor 31. When all of the coins have been delivered to the elevator 32 using the belt conveyor 31, the control device 28 stops the belt conveyor 31 and elevates the elevator 32 to discharge the coins to the coin outlet 33. In this manner, it is possible to withdraw coins, being objects of dispensing, by denomination and by quantity, from the coin outlet 33. That is, coins are dispensed as required to the coin outlet 33 from the storing and feeding parts 27*a* to 27*f* by denomination.

The setting may be such that the distance between the differentiating part 73 and the belt conveyor 31 is reduced, so that when the belt conveyor 71 is stopped when the differentiating part 73 detects a coin, the coin detected immediately prior by the differentiating part 73 has completed being delivered to the belt conveyor 31. In this case, the counting sensor 60 is not installed, and the control device 28 feeds the coins separated one by one and conveyed by the belt conveyor 55, the belt conveyor 71 and the separating roller 72, and stops them when the differentiating part 73 detects the first coin that exceeds the quantity of coins to be dispensed. In the next dispensing processing, the control device 28 starts counting from the coin that has stopped in the detection position in the differentiating part 73.

[Coin Checking Mode]

Next is a description of the case in which the coin checking mode is selected and set by an appropriate input to the display operation part 29 being performed.

When a start operation is input to the display operation part 29 in a state in which the coin checking mode is selected, the control device 28 performs control corresponding to the coin checking mode set by the display operation part 29 on all the storing and feeding parts 27*a* to 27*f*. To be specific, the control device 28 switches the gate 75 to a closed state as shown in FIG. 8A and FIG. 8B, and at the same time, that is, in parallel, drives the belt conveyor 55 provided in the first storing part 51, and the belt conveyor 71, in the direction in which the coins are conveyed toward the belt conveyor 31, and also drives the belt conveyor 31 in the direction in which the coins are conveyed toward the elevator 32.

Then, in each of the storing and feeding parts 27*a* to 27*f*, the coins stored in the first storing part 51 are separated one by one and conveyed by the belt conveyor 55, the belt conveyor 71, and the separating roller 72. The control device 28 differentiates the denominations of the coins separated one by one in this manner, counts them using the differentiating part 73 while delivering the coins to the belt conveyor 31, and allows the gate 75 to discharge them to the second storing part 52 constituting the same storing and feeding part. The belt conveyor 65 provided in the second storing part 52 is in a stopped state at this time. As a result, the coins are stored in the second storing part 52. In each of the storing and feeding parts 27*a* to 27*f*, if it is detected that there is no coin at the bottom of the first storing part 51 using a sensor provided at the bottom (not shown in the figures), and a predetermined time has elapsed since the differentiating part 73 did not detect a coin, the control device 28 determines that all of the coins in the first storing part 51 are stored in the second storing part 52 constituting the same storing and feeding part. Next, the control device 28 returns the gate 75 to the open state with the belt conveyor 55, the belt conveyor 71, and the belt conveyor 31 being stopped. The control device 28 displays the differentiation results (the quantity of coins by denomination) from the differentiating parts 73 of all of the storing and feeding parts 27*a* to 27*f* on the display operation part 29, and stores the results in a memory part.

Afterwards, the control device 28 drives the belt conveyor 65 provided in the second storing part 52 while leaving the belt conveyor 55, the belt conveyor 71, and the belt conveyor 31 in a stopped state, and returns the coins in the second storing part 52 to the first storing part 51. At this time, if it is detected that there is no coin at the bottom of the second storing part 52 using a sensor provided at the bottom (not shown in the figures), and a predetermined time has elapsed thereafter, the control device 28 determines that all of the coins in the second storing part 52 are stored in the first storing part 51 constituting the same storing and feeding part. Next, the control device 28 terminates coin checking mode with the belt conveyor 65 being stopped.

Hereunder is a description of the case in which the differentiating part 73 detects a coin of foreign denomination during checking processing. In this case, the control device 28 stops temporarily all of the belt conveyors 55, the belt conveyors 71, and the separating rollers 72 of the storing and feeding parts 27*a* to 27*f* immediately before the coin of foreign denomination is fed to the belt conveyor 31. Afterwards, the control device 28 stops the belt conveyor 31 when all of the coins on the belt conveyor 31 are stored in the corresponding second storing parts 52, and also sets all of the gates 75 of the storing and feeding parts 27*a* to 27*f* to the open state. Next, it reverses the belt conveyor 31, and by feeding only the coin of foreign denomination by the belt conveyor 31, the coin is recovered in a coin receiving and recovering part. Afterwards, the checking processing is resumed.

In the manner described above, in the case where the coin checking mode is set by the display operation part 29, the control device 28 performs the following checking processing in the storing and feeding parts 27*a* to 27*f* of all denominations in parallel. That is, all of the coins in the first storing part 51 are separated one by one, and conveyed by the belt conveyor 55, the belt conveyor 71, and the separating roller 72, and the denominations and the quantity of the coins are differentiated and counted by the differentiating part 73. Furthermore, the coins are stored in the second storing part 52 by the belt conveyor 31 and the gate 75. Afterwards, they are returned to the first storing part 51 by the belt conveyor 65.

The quantity of the coins may be confirmed as follows. A counting sensor for counting coins is provided at the top of the belt conveyor 65 of the second storing part 52. When all of the coins from the first storing part 51 are stored in the second storing part 52, and the coins are conveyed from the second storing part 52 to the first storing part 51 by the belt conveyor 65, the counting sensor performs counting to confirm the quantity of coins.

According to the coin receiving and dispensing machine 1 according to the first embodiment as described above, in each of the storing and feeding parts 27*a* to 27*f* by denomination, if the coins are separated one by one and conveyed by the belt conveyor 55, the belt conveyor 71, and the separating roller 72 from the first storing part 51, while differentiating the denominations of the coins and counting them in the differentiating part 73, and the coins are switched toward the coin outlet 33 by the gate 75, it is possible to dispense the coins. In the storing and feeding parts 27*a* to 27*f* by denomination, if the coins are separated one by one, and conveyed by the belt conveyor 55, the belt conveyor 71, and the separating roller 72 from the first storing part 51, while differentiating the denominations of the coins and counting them by the differentiating part 73, and the coins are switched toward the second storing part 52 by the belt conveyor 31 and the gate 75, it is possible to perform the checking processing. Furthermore, if, afterwards, the coins are returned from the second storing part 52 to the first storing part 51 by the belt conveyor 65, the coins can be in the state of waiting for being dispensed to the coin outlet 33. In addition, a first storing part 51, a second storing part 52, a belt conveyor 55, a belt conveyor 71 and a separating roller 72, a belt conveyor 65, a differentiating part 73 and a gate 75 are provided in each of the storing and feeding parts 27*a* to 27*f* by denomination. By so doing, in the case where the coin checking mode is set, the control device 28 can perform the checking processing in the storing and feeding parts 27*a* to 27*f* of all denominations in parallel. As a result, it is possible to perform the checking processing in a short time.

Moreover, since the second storing part 52 is provided parallel to the first storing part 51 in the horizontal direction, it is possible to avoid a great size in the vertical direction, and furthermore, since the direction in which the first storing part 51 and the second storing part 52 are provided parallel to is the direction perpendicular to the direction in which the storing and feeding parts 27*a* to 27*f* by denomination are provided parallel to, it is also possible to avoid a great overall size in the horizontal direction.

Furthermore, in both of the dispensing processing in which coins are conveyed from the first storing part 51 to the coin outlet 33, and the checking processing in which coins are conveyed from the first storing part 51 to the second storing part 52, the coins are separated one by one by the separating roller 72. Therefore, it is possible to perform differentiation in the differentiating part 73 correctly using a simple construction. Moreover, since the separating roller 72 and the differentiating part 73 are provided in the upper part of the second storing part 52, the separating roller 72 and the differentiating part 73 can be arranged compactly.

Moreover, the coins that are differentiated and counted in the differentiating part 73 are switched between the second storing part 52 and the coin outlet 33 selectively by the gate 75 that can be opened and closed. In this manner, it is possible to switch coins using a simple construction.

Furthermore, since the control device 28 controls the opening and closing of the gate 75 based on the mode set by the display operation part 29, the gate 75 can be opened and closed in accordance with the mode.

Moreover, the first storing part 51 has a wide storage cavity forming part 53 and a narrow conveyor location cavity forming part 54 in which the belt conveyor 55 is located, and has an approximately L-shaped plan view. Similarly, the second storing part 52 has a wide storage cavity forming part 63 and a narrow conveyor location cavity forming part 64 in which the belt conveyor 65 is located, and has an approximately L-shaped plan view. The storing parts 51 and 52 are arranged such that their directions are 180 degrees opposite to each other (that is, they are arranged in point symmetry), and their conveyor location cavity forming parts 54 and 64 are arranged adjacent to each other to make a square shape overall. Therefore, it is possible to arrange the two storing parts 51 and 52 compactly while ensuring that the quantity of coins that can be stored is maintained by making the size of the storage cavity forming parts 53 and 63 large.

Next is a description of a coin receiving and dispensing machine according to a second embodiment of the present invention, focusing mainly on the parts different from the first embodiment, with reference to FIG. 9A, FIG. 9B, FIG. 10A, and FIG. 10B. Parts similar to those in the first embodiment are denoted by the same reference symbols, and descriptions thereof are omitted.

In the second embodiment, for each of the storing and feeding parts 27*a* to 27*f* by denomination, as in the example of the storing and feeding part 27*a* shown in FIG. 9A, FIG. 9B, FIG. 10A, and FIG. 10B, instead of the belt conveyor 71, the separating roller 72 and the gate 75 according to the first embodiment, a hopper (first conveying part) 80, a rotating disc (first conveying part) 81, a separating and feeding part (first conveying part) 82, a conveying path (first conveying part) 83, a conveyor belt (first conveying part) 84, a differentiating part 73, and a gate (coin switching part) 85, are provided. The hopper 80 receives coins that are conveyed to be elevated by the belt conveyor 55. The rotating disc 81 forms the base of the hopper 80, and can rotate horizontally. The separating and feeding part 82 is provided on the opposite side of the hopper 80 from the belt conveyor 55, and has an aperture for one coin. The separating and feeding part 82 separates coins moving toward the outside of the rotating disc 81 by the centrifugal force applied thereby, and feeds them one by one, and can also control the timing of feeding. The conveying path 83 is a horizontal straight line, and guides the coins fed from the separating and feeding part 82. The conveyor belt 84 presses the coins fed from the separating and feeding part 82 to the conveying path 83 from above and conveys them toward the opposite side from the separating and feeding part 82, that is, the belt conveyor 31 side. The differentiating part 73 differentiates and counts the coins on the conveying path 83. The gate 85 can be opened and closed, and drops the coins on the conveying path 83 after being differentiated in the differentiating part 73. The hopper 80, the rotating disc 81, the separating and feeding part 82, the conveying path 83, the conveyor belt 84, the differentiating part 73, and the gate 85 are provided in the upper part of the base part 63*a* in the storage cavity forming part 63 of the second storing part 52. Thus, the coins dropped from the conveying path 83 by the gate 83 being opened, drop into the storage cavity forming part 63 in the second storing part 52.

Next is a description of the control performed by the control device 28 according to the second embodiment. The selecting and counting mode is similar to that in the first embodiment, and therefore the description is omitted.

[Coin Dispensing Mode]

A case is described in which the coin dispensing mode is selected and set by an appropriate input to the display operation part 29 being performed.

When a start operation is input to the display operation part 29 in a state in which the coin dispensing mode is selected and the quantity of coins to be dispensed is set by denomination, the control device 28 performs control corresponding to the coin dispensing mode set by the display operation part 29. To be specific, the control device 28 controls the belt conveyor 55 provided in the first storing part 51 of the storing and feeding parts from which coins are to be dispensed, among the storing and feeding parts 27*a* to 27*f* the rotating disc 81, and the conveyor belt 84, so that the belt conveyor 55, the rotating disc 81, and the conveyor belt 84 are driven in the direction in which the coins are conveyed toward the belt conveyor 31, and controls the belt conveyor 31 so that the belt conveyor 31 is driven in the direction in which the coins are conveyed toward the elevator 32 waiting at the lower limit position, while keeping the gate 85 in a closed state.

Then, the coins stored in the first storing part 51 in the storing and feeding part from which coins are to be dispensed, among the storing and feeding parts 27*a* to 27*f*, are conveyed one by one by holding on the cleats 58 of the belt conveyor 55, and furthermore are separated one by one, and conveyed by the hopper 80, the rotating disc 81, the separating and feeding part 82, the conveying path 83, and the conveyor belt 84. The control device 28 stops the belt conveyor 55 when the quantity of coins required to be dispensed has been counted by the counting sensor 60. Furthermore, the control device 28 differentiates the denominations of the coins separated by the hopper 80, the rotating disc 81, the separating and feeding part 82, the conveying path 83, and the conveyor belt 84 one by one, and counts them using the differentiating part 73, delivers the coins to the belt conveyor 31, and afterwards stops the rotating disc 81 and the conveyor belt 84. The control device 28 commands all the storing and feeding parts of the storing and feeding parts 27*a* to 27*f* which store the coins to be dispensed, among the storing and feeding parts 27*a* to 27*f*, to feed all of the quantities of coins, being the objects of the dispensing, to the belt conveyor 31. When all of the coins have been delivered to the elevator 32 by the belt conveyor 31, the control device 28 stops the belt conveyor 31, and elevates the elevator 32 to discharge the coins to the coin outlet 33. In this manner, it is possible to withdraw coins, being objects of dispensing, by denomination and by quantity, from the coin outlet 33.

[Coin Checking Mode]

Next is a description of the case in which the coin checking mode is selected and set by performing appropriate input to the display operation part 29.

Figure 10A:
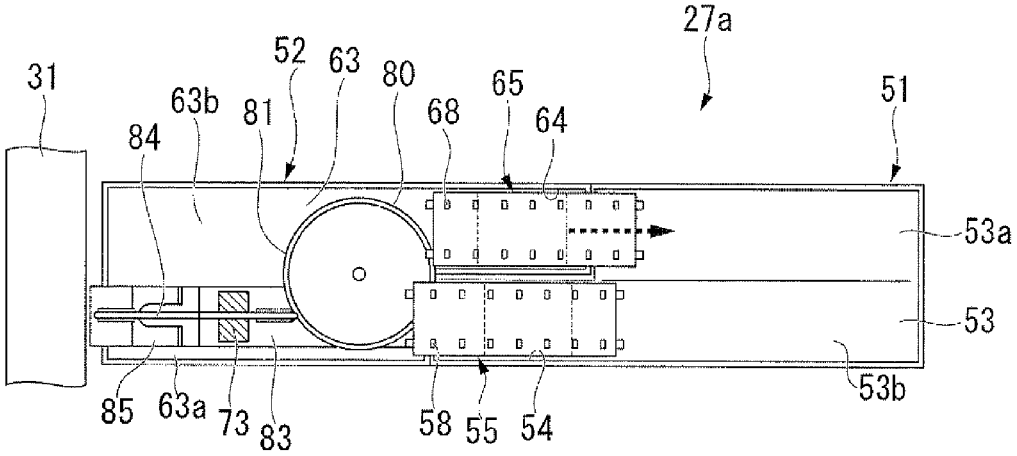
FIG. 10A is a plan view showing the storing and feeding part of the coin receiving and dispensing machine according to the second embodiment of the present invention.
Figure 10B:
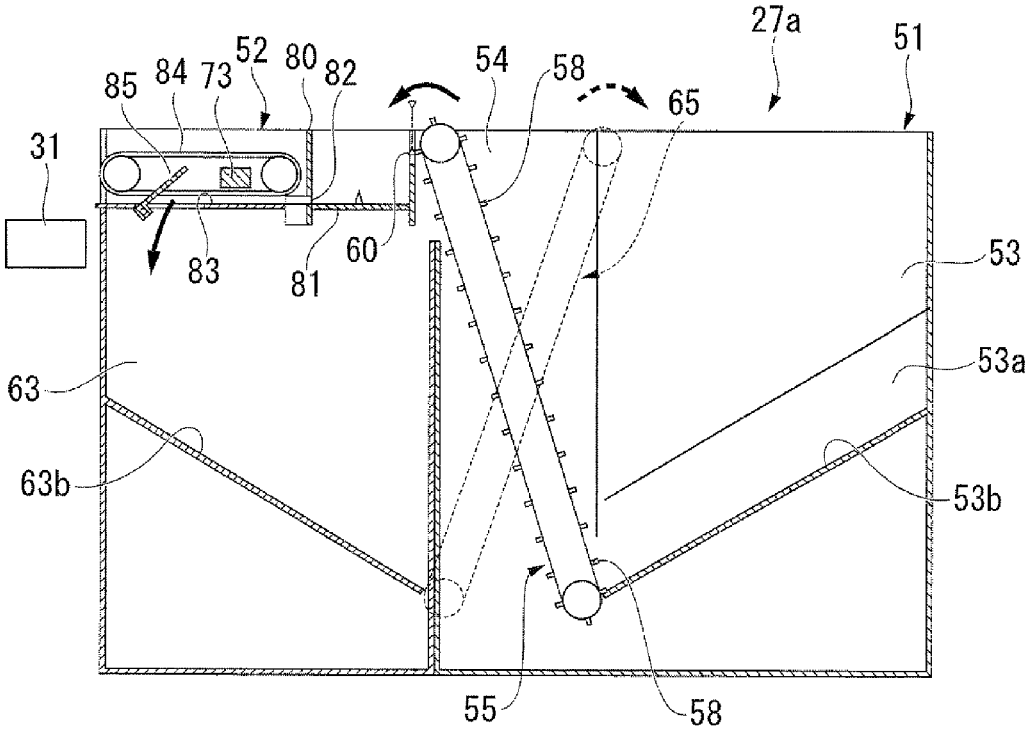
FIG. 10B is a front sectional view showing the storing and feeding part of the coin receiving and dispensing machine according to the second embodiment of the present invention.

When a start operation is input to the display operation part 29 in a state in which the coin checking mode is selected, the control device 28 performs control corresponding to the coin checking mode set by the display operation part 29 on all the storing and feeding parts 27*a* to 27*f*. To be specific, the control device 28 switches the gate 85 to an open state as shown in FIG. 10A and FIG. 10B, and at the same time, that is, in parallel, drives the belt conveyor 55 provided in the first storing part 51, the rotating disc 81, and the conveyor belt 84, in the direction in which the coins are conveyed toward the belt conveyor 31. The belt conveyor 31 maintains a stopped state.

Then, in each of the storing and feeding parts 27*a* to 27*f*, the coins stored in the first storing part 51 are separated one by one, and conveyed by the belt conveyor 55, the hopper 80, the rotating disc 81, the separating and feeding part 82, the conveying path 83, and the conveyor belt 84. The control device 28 differentiates the denominations of the coins separated one by one, and counts them in this manner using the differentiating part 73 while discharging them from the conveying path 83 to the storage cavity forming part 63 in the second storing part 52 constituting the same storing and feeding part via the gate 85 in an open state. At this time, the belt conveyor 65 provided in the second storing part 52 is in a stopped state. Thus, the coins are stored in the second storing part 52. In each of the storing and feeding parts 27*a* to 27*f*, if it is detected that there is no coin at the bottom of the first storing part 51, using a sensor provided at the bottom (not shown in the figures), and a predetermined time has elapsed since the differentiating part 73 did not detect a coin, the control device 28 determines that all of the coins in the first storing part 51 are stored in the second storing part 52 constituting the same storing and feeding part. Next, the control device 28 returns the gate 85 to the closed state with the belt conveyor 55, the rotating disc 81, and the conveyor belt 84 being stopped. The control device 28 displays the differentiation results from the differentiating parts 73 of all of the storing and feeding parts 27*a* to 27*f* on the display operation part 29, and also stores the results in a memory part.

Afterwards, the control device 28 drives the belt conveyor 65 provided in the second storing part 52 while leaving the belt conveyor 55, the rotating disc 81, and the belt conveyor 84 in a stopped state, and returns the coins in the second storing part 52 to the first storing part 51. At this time, if it is detected that there is no coin at the bottom of the second storing part 52, using a sensor provided at the bottom (not shown in figures), and a predetermined time has elapsed thereafter, the control device 28 determines that all of the coins in the second storing part 52 are stored in the first storing part 51 constituting the same storing and feeding part. Next, the control device 28 terminates coin checking mode with the belt conveyor 65 being stopped.

In a case where the differentiating part 73 detects a coin of foreign denomination during the checking processing, the coin of foreign denomination is fed to the belt conveyor 31 in a stopped state by closing the gate 85. In the case where the coin of foreign denomination is detected in the checking processing in this manner, the control device 28 retrieves the coin of foreign denomination using the belt conveyor 31.

In the manner described above, in the case where the coin checking mode is set by the display operation part 29, the control device 28 performs the following checking processing in the storing and feeding parts 27*a* to 27*f* of all denominations in parallel. That is, all of the coins in the first storing part 51 are separated one by one, and conveyed by the belt conveyor 55, the hopper 80, the rotating disc 81, the separating and feeding part 82, the conveying path 83, and the conveyor belt 84, and the denominations of the coins are differentiated and the coins are counted by the differentiating part 73. Furthermore, the coins are stored in the second storing part 52 by the gate 85. Afterwards, they are returned to the first storing part 51 by the belt conveyor 65.

According to the coin receiving and dispensing machine 1 according to the second embodiment described above, in each of the storing and feeding parts 27*a* to 27*f* by denomination, if the coins are separated one by one and conveyed by the belt conveyor 55, the hopper 80, the rotating disc 81, the separating and feeding part 82, the conveying path 83, and the conveyor belt 84 from the first storing part 51, while differentiating the denominations of the coins and counting the coins by the differentiating part 73, and are switched toward the coin outlet 33 by the gate 85, it is possible to dispense the coins, In each of the storing and feeding parts 27*a* to 27*f* by denomination, if the coins are separated one by one and conveyed by the belt conveyor 55, the hopper 80, the rotating disc 81, the separating and feeding part 82, the conveying path 83, and the conveyor belt 84 from the first storing part 51, while differentiating the denominations of the coins and counting the coins by the differentiating part 73, and are switched toward the second storing part 52 by the gate 85, it is possible to perform the checking processing. Furthermore, if, afterwards, the coins are returned from the second storing part 52 to the first storing part 51 by the belt conveyor 65, the coins can be in the state of waiting for being dispensed to the coin outlet 33. In addition, a first storing part 51, a second storing part 52, a belt conveyor 55, a belt conveyor 65, a hopper 80, a rotating disc 81, a separating and feeding part 82, a conveying path 83, a conveyor belt 84, a differentiating part 73, and a gate 85 are provided in each of the storing and feeding parts 27*a* to 27*f* by denomination. By employing this structure, in the case where the coin checking mode is set, the control device 28 can perform the checking processing in the storing and feeding parts 27*a* to 27*f* of all denominations in parallel. As a result, similarly to the first embodiment, it is possible to perform the checking processing in a short time.

Furthermore, in both of the dispensing processing for conveying coins from the first storing part 51 to the coin outlet 33, and the checking processing for conveying coins from the first storing part 51 to the second storing part 52, coins moving toward the outside by the centrifugal force of the rotating disc 81 rotating are separated and fed one by one. As a result, it is difficult for coins to become jammed or the like, so that it is possible to separate them reliably for differentiation in the differentiating part 73.

Moreover, since the rotating disc 81, the separating and feeding part 82, and the differentiating part 73 are provided in the upper part of the second storing part 52, the rotating disc 81, the separating and feeding part 82, and the differentiating part 73 can be arranged compactly.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A coin receiving and dispensing machine comprising:

a coin conveying part to convey coins received at an inlet of the machine;

an identifying part that identifies a denomination of the coins;

a plurality of temporary holding parts, each of the temporary holding parts configured to receive and hold a respective denomination of the coins;

a base part forming body to close bottom portions of the plurality of temporary holding parts;

a return box positioned vertically below the plurality of temporary holding parts, the return box configured to receive coins to be returned to an operator; and a plurality of storing and feeding parts, each of the storing and feeding parts configured to receive a respective denomination of the coins and dispense coins to a coin outlet as required, each of said plurality of storing and feeding parts comprising:

a first storing part which receives coins that are input and classified by one of the denominations;

a second storing part which is provided parallel to said first storing part in a horizontal direction, and is in immediate contact with said first storing part, and stores coins separately from said first storing part, a surface of a casing of said second storing part being provided on a surface of a casing of said first storing part;

a first conveying part which includes a first belt conveyor conveying the coins stored in said first storing part one by one, said first belt conveyor inclining upwardly toward said second storing part;

a differentiating part which differentiates the denominations of the coins conveyed by said first conveying part, and counts quantity of the coins;

a coin switching part which switches the coins differentiated and counted by said differentiating part to either one of said coin outlet and said second storing part selectively; and a second conveying part which includes a second belt conveyor conveying the coins stored in said second storing part to said first storing part, said second belt conveyor inclining upwardly toward said first storing part at approximately the same angle as said first belt conveyor, wherein the plurality of storing and feeding parts are positioned vertically below the plurality of temporary holding parts, and wherein the base part forming body is configured to move selectively relative to the plurality of temporary holding parts to open the bottom portions thereof and thereby cause the coins held in the temporary holding parts to be dispensed into either the return box or the plurality of storing and feeding parts.

2. The coin receiving and dispensing machine according to claim 1 wherein said first conveying part further includes a separating roller which separates coins conveyed from said first belt conveyor one by one, and said separating roller and said differentiating part are provided in an upper part of said second storing part.

3. The coin receiving and dispensing machine according to claim 1 wherein said first conveying part further includes a rotating disc which applies centrifugal force to coins conveyed from said first belt conveyor by rotating and moves the coins toward an outside, and a separating and feeding part which separates the coins moved toward the outside by said rotating disc and feeds the coins one by one, and said rotating disc, said separating and feeding part, and said differentiating part are provided in an upper part of said second storing part.

4. The coin receiving and dispensing machine according to claim 1, wherein said coin switching part includes a gate that opens and closes, and said coin receiving and dispensing machine further comprises a mode setting part which receives selection and setting of either one of a coin dispensing mode and a coin checking mode, and a gate control part which controls the opening and closing of said gate based on a mode set by using said mode setting part.

5. The coin receiving and dispensing machine according to claim 4, further comprising an operation control part which performs a checking process in all of said plurality of storing and feeding parts in parallel in response to the coin checking mode set by said mode setting part, the checking process including the operations that all the coins stored in said first storing part are separated one by one and conveyed by said first conveying part, denominations of the coins are differentiated and quantity of the coins is counted by said differentiating part, and after the coins are stored in said second storing part by said coin switching part, the coins are returned to said first storing part by said second conveying part.

6. The coin receiving and dispensing machine according to claim 1, wherein said first storing part and said second storing part both have approximately L-shaped plan views, and are located such that orientations of said first storing part and said second storing part are 180 degrees opposite to each other, forming a square plan view overall.

7. The coin receiving and dispensing machine according to claim 6, wherein said first storing part includes a first conveyor location cavity forming part in which said first belt conveyor is installed, and a first storage cavity forming part in which coins are stored, and whose width is greater than a width of said first conveyor location cavity forming part, said first storing part having an approximately L-shaped plan view, said second storing part includes a second conveyor location cavity forming part in which said second belt conveyor is installed, and a second storage cavity forming part in which coins are stored, and whose width is greater than a width of said second conveyor location cavity forming part, said second storing part having an approximately L-shaped plan view, and said first conveyor location cavity forming part of said first storing part and said second conveyor location cavity forming part of said second storing part are arranged adjacent to each other.

8. The coin receiving and dispensing machine according to claim 1, wherein said first belt conveyor is contained in said first storing part, and said second belt conveyor is contained in said second storing part.

9. The coin receiving and dispensing machine according to claim 1, wherein said first conveyor is located inside said casing of said first storing part, and said second conveyor is located inside said casing of said second storing part.

* * * * *